US007219508B2

(12) United States Patent
Durbin

(10) Patent No.: US 7,219,508 B2
(45) Date of Patent: May 22, 2007

(54) EVAPORATOR ASSEMBLY FOR COLD TABLES AND METHOD FOR REFRIGERATING COLD TABLES

(75) Inventor: Michael J. Durbin, 640 Avondale Dr., St. Peters, MO (US) 63376

(73) Assignee: Michael J. Durbin, Saint Peters, MO (US)

( * ) Notice: Subject to any disclaimer, the term of this patent is extended or adjusted under 35 U.S.C. 154(b) by 103 days.

(21) Appl. No.: 11/086,485

(22) Filed: Mar. 22, 2005

(65) Prior Publication Data

US 2005/0204765 A1 Sep. 22, 2005

Related U.S. Application Data

(60) Provisional application No. 60/555,065, filed on Mar. 22, 2004.

(51) Int. Cl.
*A47F 3/04* (2006.01)

(52) U.S. Cl. ..... 62/257; 62/426; 165/122

(58) Field of Classification Search ..... 62/258, 62/426; 165/122, 127
See application file for complete search history.

(56) References Cited

U.S. PATENT DOCUMENTS 2,042,420 A * 5/1936 Askin ..... 62/286
2,251,907 A * 8/1941 Hoesel ..... 62/285
2,495,002 A * 1/1950 Hart ..... 62/280
2,655,092 A * 10/1953 Spooner ..... 454/93
3,524,328 A * 8/1970 Schuster ..... 62/285
3,590,217 A * 6/1971 Steiner ..... 392/363
3,628,350 A * 12/1971 Ruth ..... 62/249
4,699,208 A * 10/1987 Wolf et al. ..... 165/47
6,155,065 A 12/2000 da Silva
6,374,628 B2 * 4/2002 Willkommen ..... 62/288
6,536,223 B1 * 3/2003 Haasis et al. ..... 62/258
6,990,824 B1 * 1/2006 Jaffer et al. ..... 62/255

* cited by examiner

*Primary Examiner*—William E. Tapolcai
(74) *Attorney, Agent, or Firm*—Thompson Coburn LLP

(57) ABSTRACT

An evaporator assembly for refrigerating a cold table comprises a housing, an evaporator coil, and at least one electric fan. The housing comprises a mounting portion that is configured and adapted to support the housing from a vertical wall of the cold table. The evaporator is inclined within the housing to reduce the occurrence of evaporator freeze-up. The evaporator assembly is configured to discharge air from the housing both upward and horizontally. Air is drawn into the housing from a space between the housing and the vertical wall of the cold table.

21 Claims, 5 Drawing Sheets

EVAPORATOR ASSEMBLY FOR COLD TABLES AND METHOD FOR REFRIGERATING COLD TABLES

The application claims priority to copending U.S. Provision Patent Application No. 60/555,065, filed on Mar. 22, 2004, titled SLOPED COIL EVAPORATOR, the disclosure of which is hereby incorporated in its entirety by reference.

BACKGROUND OF THE INVENTION

This invention pertains to commercial cold tables of the type used in the food service industry. More particularly, this invention pertains to evaporator assemblies utilized for refrigerating cold tables.

Commercial cold tables are utilized in the food service industry to provide means for chilling containers of food that are exposed to ambient air from above. Commercial cold tables often comprise a refrigerated interior air chamber that is accessible by more or more hinged doors. The air chamber is typically refrigerated using an evaporator assembly. The top of the air chamber is bounded by a plurality of serving containers that can be selectively removed and replaced. Thus, while food placed in the serving containers is exposed to the ambient air, refrigerated air within the air chamber cools the serving containers and thereby chills the food in the containers. The refrigerated air chamber of a cold chamber is often also utilized to store containers of food for future use.

The safety guidelines and requirements related to the use of cold tables have changed over time and have resulted in the need to achieve lower average temperatures of the food placed in the serving containers. However, many cold tables are unable to achieve these lower temperatures due to the limitations imposed by their evaporator assemblies that refrigerate their air chambers. The evaporator assemblies utilized in older cold tables often comprised a housing, one or electric fans, and an evaporator coil. Older evaporator assemblies were typically configured such that the fans drew air into the housing of the evaporator assembly from above the evaporator coil and forced such air out of the housing in the opposite direction through the evaporator coil. To increase the ability of such evaporator assemblies to cool the exposed food containers, some evaporator assemblies have been modified by reversing the direction of the electric fan(s) such that air is drawn into the housing through the evaporator coil and is discharged from the housing by the fan(s). As result of this modification, air circulation within the air chamber is reversed and the coldest air in the air chamber is closer to the exposed serving containers, thereby allowing the cold table to achieve lower temperatures of food within the exposed serving containers.

Along with the advantages of the modified evaporator assemblies discussed above came several disadvantages. One such disadvantage is that the evaporator coil of such a modified evaporator assembly has an increased tendency to freeze-up. This is because the reversed air circulation flow direction creates a suction force on the condensation that accumulates on the convection fins of the evaporator coil. This suction force prevents the condensation from draining off evaporator coil and often results in the evaporator coil freezing-up.

Another disadvantage of the modified evaporator assemblies discussed above is that drawing air into the housing from beneath the fans has a tendency to draw debris, such as lettuce and other foods that are stored within the air chamber, into the evaporator coil. Such debris often clogs the convection fins of the evaporator coil and thereby reduces the cooling capacity of the evaporator assembly.

The present invention overcomes the above-mentioned disadvantages associated with prior art evaporator assemblies. Furthermore, the present invention enhances the efficiency of cold table evaporator assemblies by directing the coldest air within the air chamber directly toward the exposed serving containers.

SUMMARY OF THE INVENTION

The inventors of the present invention have developed a new evaporator assembly for use in connection with cold tables. The new evaporator assembly incorporates several design features that each improve the performance of the evaporator assembly.

In a first aspect of the invention, an evaporator assembly is configured and adapted for use within a cold table and comprises a housing, an evaporator coil, and at least one electric fan. The housing defines a interior cavity of the evaporator assembly and comprises a mounting portion that is configured and adapted to support the housing from a vertical wall of the cold table. The housing also comprises first and second air passageways that each connect the interior cavity of the evaporator assembly to an environment external to the evaporator assembly. The evaporator coil comprises a plurality of convection fins, each of which has opposite first and second perimeter edges. The first edges of the convection fins are generally coplanar and define a first plane of the evaporator coil. Likewise, the second edges of the convection fins are also generally coplanar and define a second plane of the evaporator coil. The evaporator coil is fixed in orientation with respect to the housing in a manner such that the first plane of the evaporator coil is inclined from vertical and horizontal when the housing is supported from the vertical wall of the cold table via the mounting portion of the housing. The fan is configured and adapted to draw air from the environment external to the evaporator assembly through the evaporator coil and into the interior cavity of the evaporator assembly via the first air passageway in a manner such that the air passes through the first and second planes of the evaporator coil. The fan is also configured and adapted to expel air from the interior cavity of the evaporator assembly into the environment external to the housing via the second air passageway in a manner such that the air has an upward vertical velocity component and a horizontal velocity component as it is expelled into the environment external to the evaporator assembly.

In a second aspect of the invention, a cold table comprises and interior air chamber and an evaporator assembly. The interior air chamber is bound by at least one generally vertical wall. The evaporator assembly comprises a housing, an evaporator coil, and an electric fan. The evaporator assembly is mounted to the wall of the cold table. The housing defines an interior cavity of the evaporator assembly and comprises first and second air passageways that each connect the interior cavity of the evaporator assembly to the interior air chamber of the cold table. The evaporator coil comprises a plurality of convection fins, each of which has opposite first and second perimeter edges. The first edges of the convection fins are generally coplanar and define a first plane of the evaporator coil. Likewise, the second edges of the convection fins are generally coplanar and define a second plane of the evaporator coil. The first plane of the evaporator coil is inclined with respect to the wall. The fan is configured and adapted to draw air from the interior air chamber of the cold table through the evaporator coil and into the interior cavity of the evaporator assembly via the first air passageway in a manner such that the air passes through the first and second planes of the evaporator coil. The fan is also configured and adapted to expel air from the interior cavity of the evaporator assembly into the interior air chamber of the cold table via the second air passageway.

In yet another aspect of the invention, a method of refrigerating a cold table comprises steps of providing a cold table, mounting an evaporator coil to the cold table, and circulating air within the cold table. The step of providing a cold table occurs in manner such that the cold table has an interior air chamber. The step of mounting the evaporator coil to the cold table occurs in a manner such that the evaporator coil is inclined. The step of circulating air within the interior air chamber of the cold table occurs in a manner such that the air is circulated through the evaporator coil in a manner drawing heat out of the air and into the evaporator coil to thereby cool the air within the interior air chamber of the cold table.

While the principal advantages and features of the invention have been described above, a more complete and thorough understanding of the invention may be obtained by referring to the drawings and the detailed description of the preferred embodiment, which follow.

Figure 1:
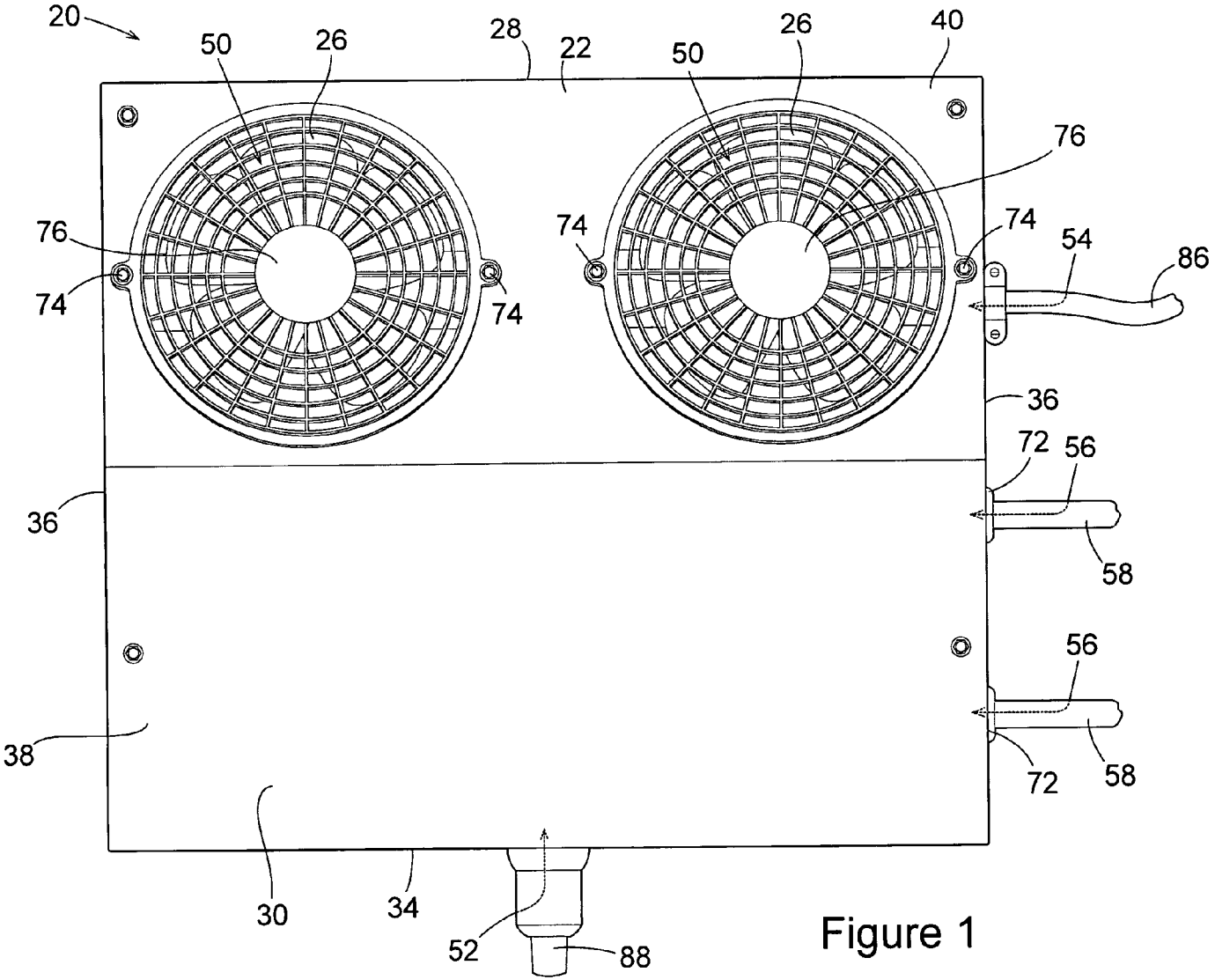
FIG. 1 is a front elevation view of the preferred embodiment of an evaporator assembly in accordance with the invention.
Figure 2:
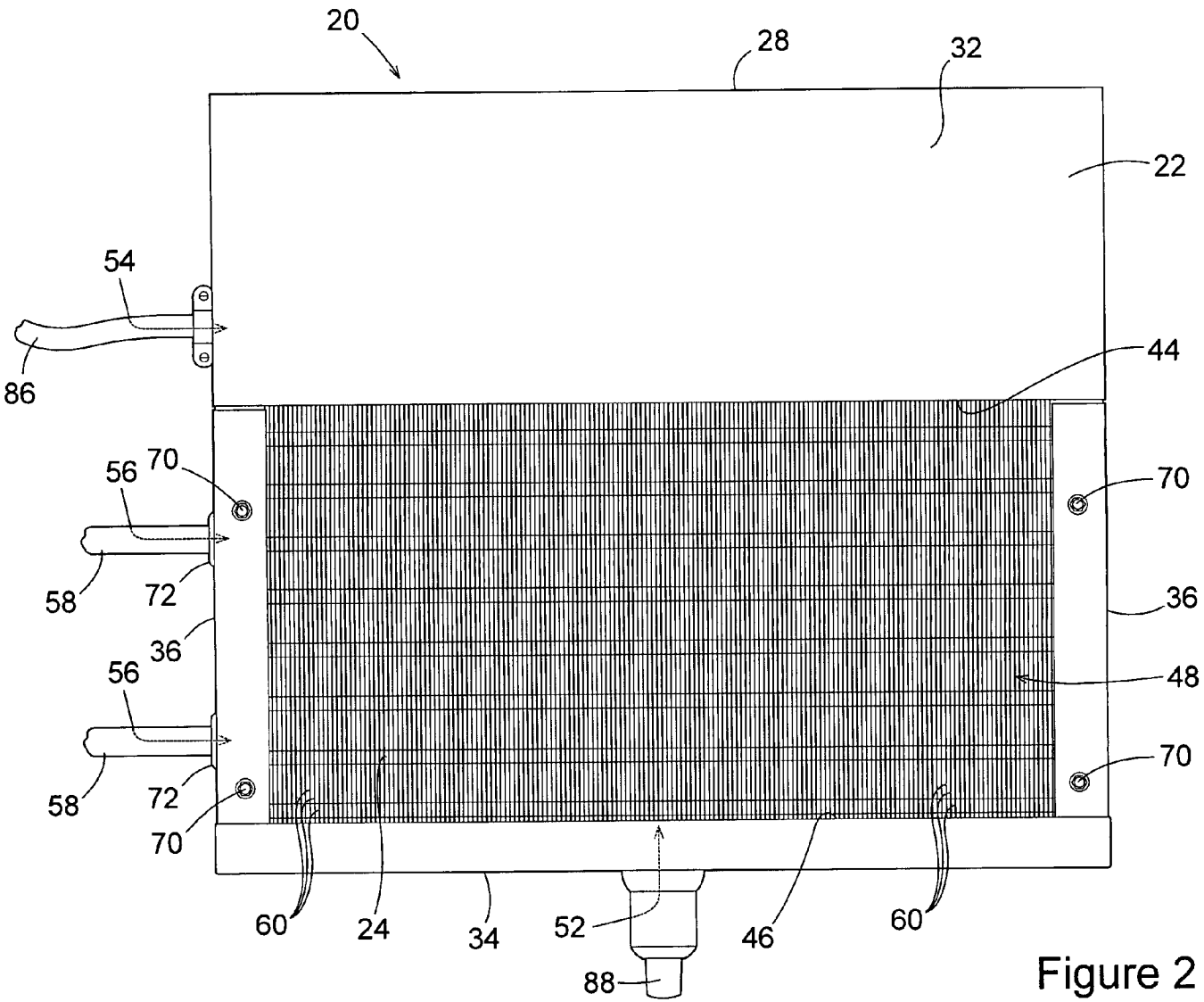
FIG. 2 is a rear elevation view of the evaporator assembly shown in FIG. 1.
Figure 3:
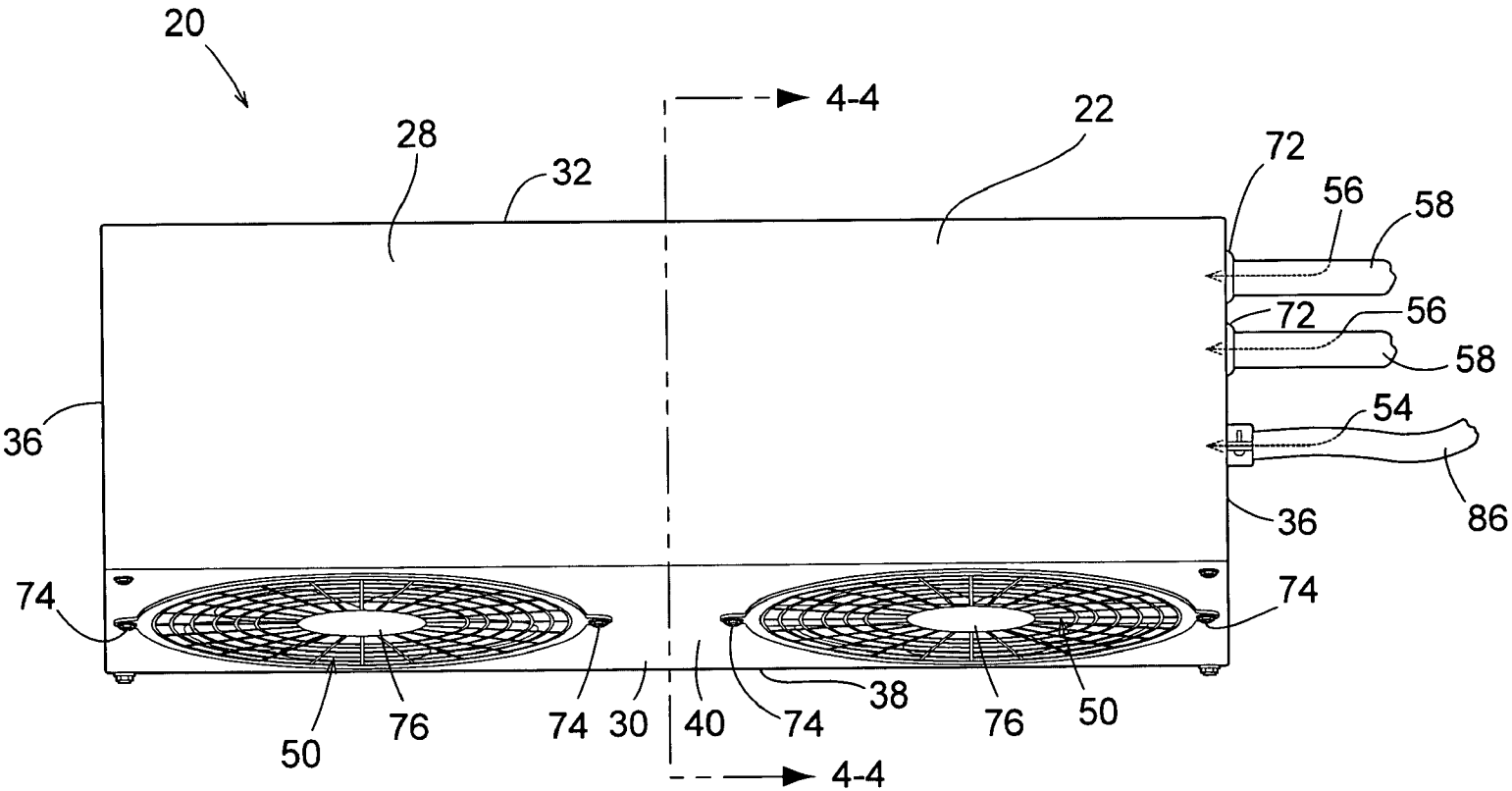
FIG. 3 is top plan view of the evaporator assembly shown in FIGS. 1 and 2.
Figure 4:
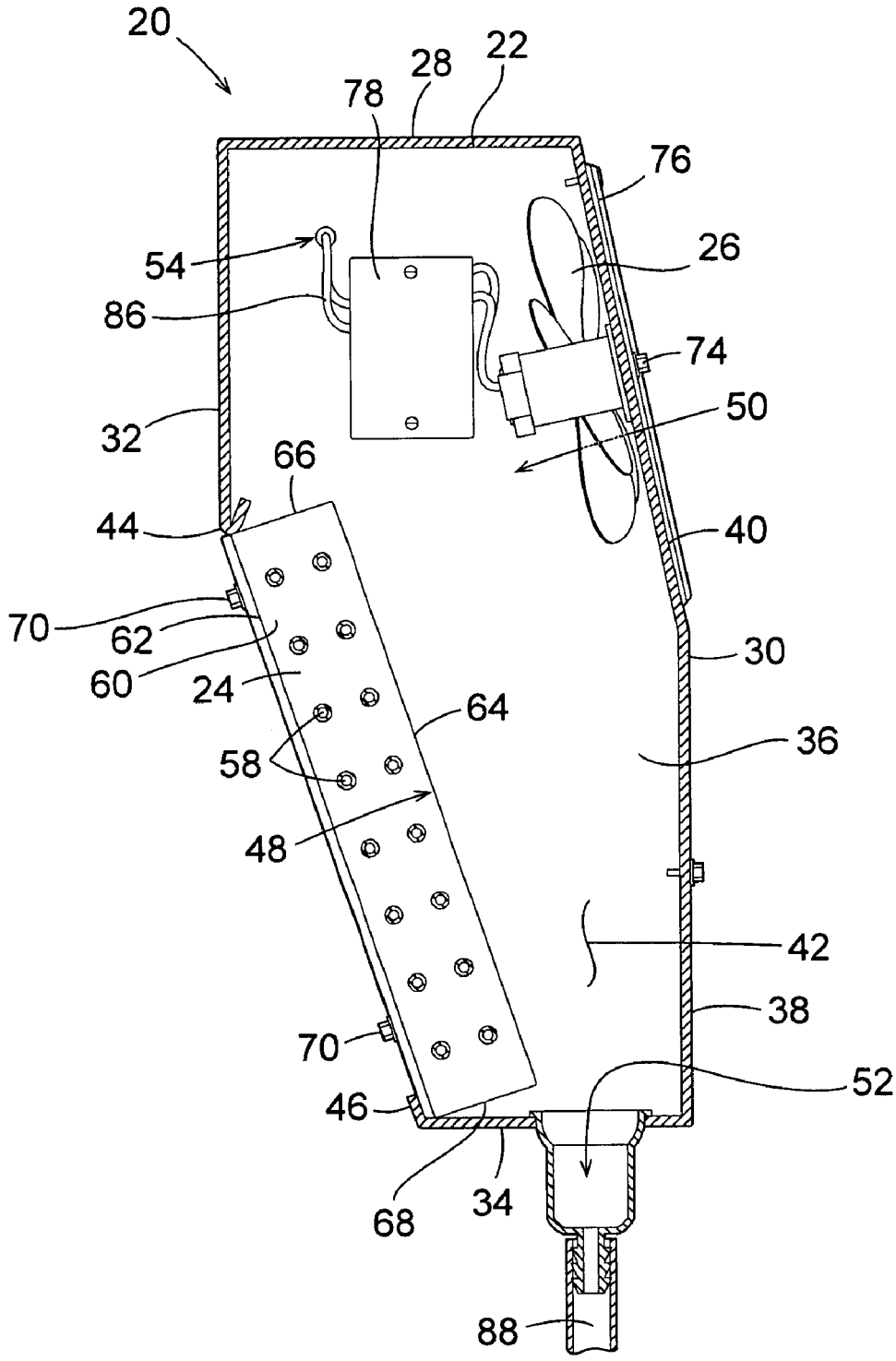
FIG. 4 is a cross-sectional view of the evaporator assembly shown in FIGS. 1–3, taken about the line 4—4 shown in FIG. 3.

Reference characters in the written specification indicate corresponding items shown throughout the drawing figures.

DETAILED DESCRIPTION OF A PREFERRED EMBODIMENT OF THE INVENTION

A preferred embodiment of an evaporator assembly in accordance with the invention is depicted in FIGS. 1–5 and is indicated by the reference numeral 20. In general, the evaporator assembly 20 comprises a housing 22, an evaporator coil 24, and one or more electric fan(s) 26.

The housing 22 of the evaporator assembly is preferably formed of sheet metal and preferably comprises a top portion 28, a front portion 30, a rear portion 32, a bottom portion 34, and opposite side portions 36. The top portion 28 of the housing 22 is preferably planar and is preferably horizontally oriented. The front portion 30 of the housing 22 preferably comprises a vertical planer portion 38 and an inclined planar portion 40 adjacent and above the vertical planer portion. The top of the inclined planar portion 40 of the front portion 30 of the housing 22 is preferably coterminous with the top portion 28 of the housing. The rear portion 32 of the housing 22 is preferably planar and vertically oriented, and is also preferably coterminous with top portion 28 of the housing. The bottom portion 34 of the housing 22 is generally horizontal with its rear most edge 46 turned upwards, and is preferably coterminous with the vertical planer portion 38 of the front portion 30 of the housing. Additionally, the bottom portion 34 of the housing 22 is preferably spaced vertically below and horizontally in front of the rear portion 32 of the housing. Each of the side portions 36 of the housing 22 is preferably planar and vertically oriented, and is preferably coterminous with each of the top 28, front 30, rear 32, and bottom 34 portions of the housing. The top 28, front 30, rear 32, bottom 34, and side portions of the housing 22 define and bound an interior air cavity 42 of the evaporator assembly 20 therebetween.

The housing 22 also comprises a plurality of openings. The space between the lower edge 46 of the rear portion 32 of the housing 22 and the rear edge 46 of the bottom portion 34, and between the side portions 36, creates an evaporator coil opening 48. Preferably, two circular fan openings 50 extend through the through the inclined planer portion 40 of the front portion 30 of the housing 22. A drain opening 52 preferably extends through the bottom portion 32 of the housing 22. One or more electrical pass-through opening(s) 54 preferably extends through either of the side portions 36 of the housing 22. Finally, one or more refrigerant line opening(s) 56 preferably extend(s) through either of the side portions 36 of the housing 22.

The evaporator coil 24 is preferably a standard off-the-shelf slab type evaporator coil. The evaporator coil 24 comprises a serpentine refrigerant line 58 and a plurality of closely spaced convention fins 60. The convection fins 60 are typically similar in size and shape to each other and each comprises opposite first 62 and second 64 perimeter edges. The first edges 62 of the convection fins 60 are generally coplanar and define a first plane of the evaporator coil 24. Likewise, the second edges 64 of the convection fins 60 are also generally coplanar and define a second plane of the evaporator coil 24. The convections fins also comprise opposite top 66 and bottom 68 perimeter edges that are coterminous with and perpendicular to the first 62 and second 64 edges of the evaporator coil 24.

The evaporator coil 24 is preferably positioned within the housing 22 of the evaporator assembly 20 in an inclined orientation immediately adjacent the evaporator coil opening 48. A plurality of fasteners 70 secure the evaporator coil 24 to the housing 22. The opposite ends 72 of the refrigerant line 58 of the evaporator coil 24 preferably extend through the refrigerant line opening(s) 56 of the housing 22. Preferably, grommets 72 or mastic material can be utilized to block the passage of any air through the refrigerant line opening(s) 56.

The electric fans 26 are preferably off-the-shelf fans of the type typically used in evaporator assemblies. Each fan 26 is preferably positioned within the housing 22 adjacent one of the fan openings 50 that extend through the inclined planar portion 40 of the front portion 30 of the housing. A pair of fasteners 74 preferably sandwich the inclined planar portion 40 of the housing 22 between each one of the fans 26 and a fan grill 76 that covers the fan opening 50 on the exterior of the housing. As such, it should be appreciated that each fan 26 is inclined in a manner such that its axis of rotation is normal to the inclined planar portion 40 of the front portion 30 of the housing 22. An electrical junction box 78 is preferably attached to housing 22 and the fans 26 are preferably wired to the junction box.

Figure 5:
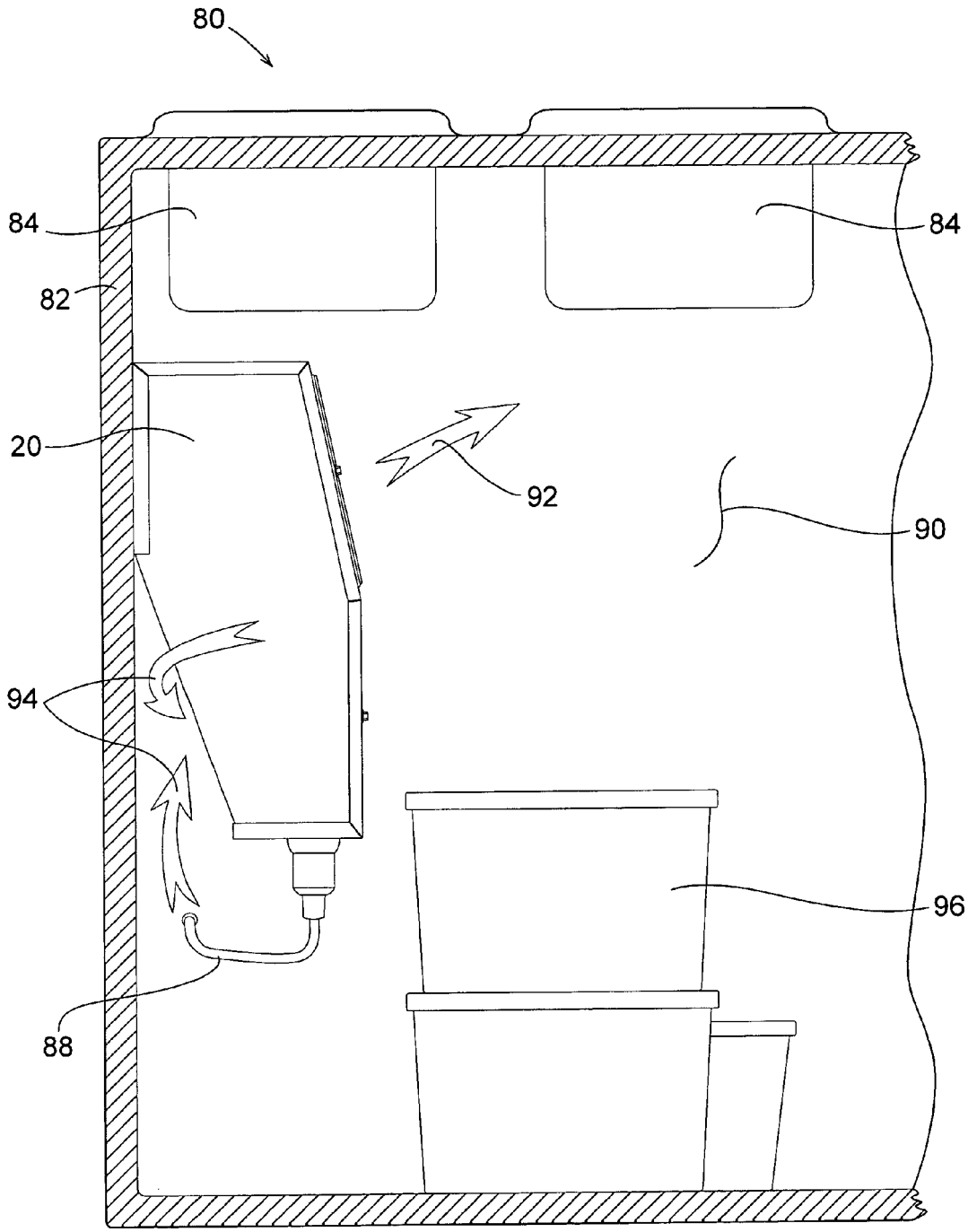
FIG. 5 is a side elevation view of the evaporator assembly shown in FIGS. 1–4 positioned within an cold table, and is shown from within the interior air chamber of the cold table.

The evaporator assembly 20 is preferably installed in a cold table 80 as shown in FIG. 5. The evaporator assembly 20 may be utilized as a replacement for a previously installed evaporator assembly or as a component part of a newly produced cold table. Regardless, the installation procedure is generally the same in either case. The evaporator assembly 20 is preferably mounted to the rear vertical wall 82 of the cold table 80 beneath the serving containers 84. This is preferably done using threaded fasteners (not shown) that extend through the rear portion 32 of the housing 22 and into the vertical wall 82 of the cold table 80. Thus, the rear portion 32 of the housing 22 acts a mounting portion for securing the evaporator assembly 20 to the cold table 80. However, it should be appreciated that other techniques for securing the evaporator assembly 20 to the cold table 80, such as using brackets, adhesives, or other types of fasteners, could be employed.

During the installation of the evaporator assembly 20 in the cold table 80, refrigerant lines from the compressor and condenser (not shown) of the cold table are connected to the refrigerant line 58 of the evaporator coil 24. Although not shown, it should be appreciated that other refrigeration components, such a solenoid valve and an expansion valve, can be attached to the refrigerant lines either inside or outside of the housing 22 of the evaporator assembly 20.

Additionally, a electrical power supply line 86 is preferably inserted through the electrical pass-through opening 54 of the housing 22 where it is then electrically connected to the fans 26 via the junction box 78. If applicable, one or more addition power supply lines may also pass through the housing 22 of the evaporator assembly 20 for controlling an internal refrigerant solenoid or other control mechanisms. Finally, a drainage tube 88 is attached to the drain opening 52 of the bottom portion 34 of the housing 22. The drainage tube 88 is preferably routed to a drain outside of the cold table 80.

During operation, the evaporator assembly 20 circulates and refrigerates the air within the air chamber 90 of the cold table 80. The fans 26 of the evaporator assembly 20 draw air from the air chamber 90 of the cold table 80 into the interior air cavity 42 of the evaporator assembly 20 through a first air passageway that extends through the evaporator coil opening 48 of the housing 22 and the evaporator coil 24. As this occurs, the fans 26 also discharge air from within the interior air cavity 42 of the evaporator assembly 20 back out into the air chamber 90 of the cold table 80 through another air passageway that extends through the fan openings 50 of the housing 22 and the fan grills 76. The general direction of air flow circulation through the evaporator assembly 20 is represented by arrows in FIG. 5.

Various aspects of the configuration of the evaporator assembly 20 are advantageous over prior art cold table evaporator assemblies. One such aspect is the inclined orientation of the evaporator coil 24. This inclination facilitates the drainage of condensation. In particular, it should be appreciated that as gravity pulls the condensation on the convection fins 60 downward, the condensation tends to be channeled by cohesion tension along the first edges 62 and bottom edges 64 of the convention fins, and down to the intersections of such edges. By channeling all of the condensation to a single corner of the convection fins 60, the gravity acting on the condensation is able to overcome the cohesion tension that resists the separation of the condensation from the convection fins. Thus, the condensation is able to drip off of the evaporator coil 24 where it then accumulates on the bottom portion 34 of the housing 22 and ultimately drains from the housing via the drainage tube 88. With prior art non-inclined evaporator coils, condensation only gathers together after reaching the bottom of the convection fins and therefore slowly moves down the fins. Moreover, condensation reaching the bottom edge of a convection fin of a non-inclined evaporator coil evenly disperses across the length of the bottom edge, thereby increasing the cohesion tension and allowing the evaporator coil to carry more water. Thus, it should be appreciated that the inclination of the evaporator coil 24 of the evaporator assembly 20 disclosed herein facilitates the drainage of condensation from the convection fins 60 and thereby reduces the occurrence of evaporator coil freeze-up.

Another beneficial aspect of the evaporator assembly 20 of the preferred embodiment relates to the inclination of inclined planar portion 40 of the front portion 30 of the housing 22 and of the fan(s) 26. This inclination causes the air discharged from the interior air cavity 42 of the evaporator assembly 20 to exit the evaporator assembly with an upward vertical velocity component and a horizontal velocity component (as depicted by the arrow indicated by reference numeral 92). As such, the discharged air, which is the coolest air in the air chamber 90 of the cold table 80, flows directly toward the serving containers 84, and thereby lowers the temperature of the serving containers and any food therein beyond what the temperature would otherwise be.

Yet another beneficial aspect of the evaporator assembly 20 of the preferred embodiment relates to how circulated air is drawn into the interior air cavity 42 of the evaporator assembly. Notably, the evaporator coil opening 48 of the housing 22 faces the rear vertical wall 82 of the cold table 82. Thus, air drawn into the interior air cavity 42 of the evaporator assembly 20 is drawn from the area of the air chamber 90 that lies between the evaporator coil opening 48 and the rear vertical wall 82 of the cold table 80 (as depicted by the arrow indicated by reference numeral 94). Thus, debris such as food parcels from food items 96 placed in the cold table 80 for storage are less likely to be sucked into the evaporator coil 24 of evaporator assembly 20. Additionally, the housing 22 prevents items pushed beneath the evaporator assembly 20 from damaging the evaporator coil 24 and shields the evaporator coil from debris dropped from above as serving containers 84 are removed and replaced during normal use of the cold table 80.

While the present invention has been described in reference to a specific embodiment, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, the evaporator assembly and variation thereof may be utilized in refrigerators and freezers other than cold tables. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Similarly, the term "portion" should be construed as meaning some or all of the item or element that it qualifies.

What is claimed is:

1. An evaporator assembly that is configured and adapted for use within a cold table comprising:

a housing, the housing defining a interior cavity, the housing comprising a mounting portion that is configured and adapted to support the housing from a vertical wall of the cold table, the housing also comprising first and second air passageways that each connect the interior cavity to an environment external to the housing, the housing being configured and adapted such that a portion of the environment external to the housing lies between the evaporator coil and the vertical wall of the cold table when the housing is supported from the vertical wall of the cold table via the mounting portion of the housing;

an evaporator coil, the evaporator coil comprising a plurality of convection fins, each of the convection fins having opposite first and second perimeter edges, the first edges of the convection fins being generally coplanar and defining a first plane, the second edges of the convection fins being generally coplanar and defining a second plane, the evaporator coil being fixed in orientation with respect to the housing in a manner such that the first plane of the evaporator coil is inclined from vertical and horizontal when the housing is supported from the vertical wall of the cold table via the mounting portion of the housing; and at least one electric fan, the fan being configured and adapted to draw air from the environment external to the housing through the evaporator coil and into the interior cavity via the first air passageway in a manner such that the air passes through the first and second planes of the evaporator coil, the fan also being configured and adapted to expel air from the interior cavity into the environment external to the housing via the second air passageway in a manner such that the air has an upward vertical velocity component and a horizontal velocity component as it is expelled into the environment external to the housing, the fan further being, configured and adapted to draw air from the portion of the environment external to the housing through the evaporator coil and into the interior cavity of the housing when the housing is supported from the vertical wall of the cold table via the mounting portion of the housing.

2. An evaporator assembly in accordance with claim 1 wherein the fan has an axis of rotation and is fixed to the housing in a manner such that the axis of rotation of the fan is inclined when the housing is supported from the vertical wall of the cold table via the mounting portion of the housing.

3. An evaporator assembly in accordance with claim 1 wherein the evaporator coil is fixed in orientation with respect to the housing in a manner such that the first plane of the evaporator coil is angled at least fifteen degrees and at most thirty degrees from vertical when the housing is supported from the vertical wall of the cold table via the mounting portion of the housing.

4. An evaporator assembly in accordance with claim 1 wherein the horizontal velocity component is greater than the vertical velocity component.

5. An evaporator assembly in accordance with claim 1 wherein the fan has an axis of rotation and is fixed to the housing in a manner such that the axis of rotation of the fan is inclined when the housing is supported from the vertical wall of the cold table via the mounting portion of the housing and wherein the horizontal velocity component is greater than the vertical velocity component.

6. An evaporator assembly in accordance with claim 1 wherein the fan has an axis of rotation and is fixed to the housing in a manner such that the axis of rotation of the fan is inclined when the housing is supported from the vertical wall of the cold table via the mounting portion of the housing, and wherein the evaporator coil is fixed in orientation with respect to the housing in a manner such that the first plane of the evaporator coil is angled at least fifteen degrees and at most thirty degrees from vertical when the housing is supported from the vertical wall of the cold table via the mounting portion of the housing.

7. A cold table comprising:

in interior air chamber, the interior air chamber being bound by at least one generally vertical wall; and an evaporator assembly, the evaporator assembly comprising a housing, an evaporator coil, and an electric fan, the evaporator assembly being mounted to the vertical wall of the cold table in a manner such that a portion of the interior air chamber of the cold table external to the housing lies between the evaporator coil and the vertical wall, the housing defining an interior cavity of the evaporator assembly and comprising first and second air passageways that each connect the interior cavity to the interior air chamber of the cold table external to the housing, the evaporator coil comprising a plurality of convection fins, each of the convection fins having opposite first and second perimeter edges, the first edges of the convection fins being generally coplanar and defining a first plane, the second edges of the convection fins being generally coplanar and defining a second plane, the first plane of the evaporator coil being inclined relative to the vertical wall, the fan being configured and adapted to draw air from the portion of the interior air chamber of the cold table through the evaporator coil and into the interior cavity evaporator assembly via the first air passageway in a manner such that the air passes through the first and second planes of the evaporator coil, the fan also being configured and adapted to expel air from the interior cavity of the evaporator assembly into the interior air chamber of the cold table via the second air passageway.

8. A cold table in accordance with claim 7 wherein the fan is configured and adapted to expel air from the interior cavity of the evaporator assembly into the interior air chamber of the cold table external to the housing via the second air passageway in a manner such that the air has an upward vertical velocity component and a horizontal velocity component as it is expelled into the interior air chamber of the cold table external to the housing.

9. A cold table in accordance with claim 8 wherein the fan has an axis of rotation and is fixed to the housing in a manner such that the axis of rotation of the fan is inclined relative to the vertical wall.

10. A cold table in accordance with claim 8 wherein the horizontal velocity component is greater than the vertical velocity component.

11. A cold table in accordance with claim 7 wherein the fan has an axis of rotation and is fixed to the housing in a manner such that the axis of rotation of the fan is inclined relative to the vertical wall.

12. A cold table in accordance with claim 7 wherein the evaporator coil is fixed in orientation with respect to the housing in a manner such that the first plane of the evaporator coil is angled at least fifteen degree and at most thirty degrees from vertical.

13. A cold table in accordance with claim 12 wherein the fan has an axis of rotation and is fixed to the housing in a manner such that the axis of rotation of the fan is inclined relative to the vertical wall.

14. An evaporator assembly that is configured and adapted for use within a cold table comprising:

a housing, the housing defining a interior cavity, the housing comprising a mounting portion that is configured and adapted to support the housing from a vertical wall of the cold table, the housing also comprising first and second air passageways that each connect the interior cavity to an environment external to the housing, the housing being configured and adapted such that a portion of the environment external to the housing lies between the evaporator coil and the vertical wall of the cold table when the housing is supported from the vertical wall of the cold table via the mounting portion of the housing;

an evaporator coil, the evaporator coil comprising a plurality of convection fins, each of the convection fins having opposite first and second perimeter edges, the first edges of the convection fins being generally coplanar and defining a first plane, the second edges of the convection fins being generally coplanar and defining a second plane, the evaporator coil being fixed in orientation with respect to the housing in a manner such that the first plane of the evaporator coil is inclined from vertical and horizontal when the housing is supported from the vertical wall of the cold table via the mounting portion of the housing; and at least one electric fan, the fan being configured and adapted to draw air from the environment external to the housing through the evaporator coil and into the interior cavity via the first air passageway in a manner such that the air passes through the first and second planes of the evaporator coil, the fan being configured and adapted to draw air from the portion of the environment external to the housing through the evaporator coil and into the interior cavity of the housing when the housing is supported from the vertical wall of the cold table via the mounting portion of the housing.

15. An evaporator assembly in accordance with claim 14 wherein the fan has an axis of rotation and is fixed to the housing in a manner such that the axis of rotation of the fan is inclined when the housing is supported from the vertical wall of the cold table via the mounting portion of the housing.

16. An evaporator assembly in accordance with claim 15 wherein the fan is configured and adapted to expel air from the interior cavity into the environment external to the housing via the second air passageway in a manner such that the air has an upward vertical velocity component and a horizontal velocity component as it is expelled into the environment external to the housing.

17. An evaporator assembly in accordance with claim 16 wherein the horizontal velocity component is greater than the vertical velocity component.

18. An evaporator assembly in accordance with claim 14 wherein the evaporator coil is fixed in orientation with respect to the housing in a manner such that the first plane of the evaporator coil is angled at least fifteen degrees and at most thirty degrees from vertical when the housing is supported from the vertical wall of the cold table via the mounting portion of the housing.

19. An evaporator assembly in accordance with claim 18 wherein the fan has an axis of rotation and is fixed to the housing in a manner such that the axis of rotation of the fan is inclined when the housing is supported from the vertical wall of the cold table via the mounting portion of the housing.

20. An evaporator assembly in accordance with claim 19 wherein the fan is configured and adapted to expel air from the interior cavity into the environment external to the housing via the second air passageway in manner such that the air has an upward vertical velocity component and a horizontal velocity component as it is expelled into the environment external to the housing.

21. An evaporator assembly in accordance with claim 20 wherein the horizontal velocity component is greater than the vertical velocity component.

* * * * *